US007854812B2

(12) United States Patent
Harman, Jr.

(10) Patent No.: US 7,854,812 B2
(45) Date of Patent: Dec. 21, 2010

(54) PROCESS FOR FINISHING WALLBOARD JOINTS

(76) Inventor: George William Harman, Jr., 13709 E. Devonfield Dr., Baldwin, MD (US) 21013

( * ) Notice: Subject to any disclaimer, the term of this patent is extended or adjusted under 35 U.S.C. 154(b) by 175 days.

(21) Appl. No.: 12/220,822

(22) Filed: Jul. 29, 2008

(65) Prior Publication Data

US 2009/0032197 A1 Feb. 5, 2009

Related U.S. Application Data

(60) Provisional application No. 60/963,141, filed on Aug. 2, 2007.

(51) Int. Cl.
*B44C 7/04* (2006.01)

(52) U.S. Cl. ..... 156/71; 156/574; 156/575; 156/577; 156/579

(58) Field of Classification Search ..... 156/71, 156/574, 575, 577, 579
See application file for complete search history.

(56) References Cited

U.S. PATENT DOCUMENTS

| | | | | | |
|---|---|---|---|---|---|
| 3,109,207 | A * | 11/1963 | Cooper | 52/255 |
| 4,313,991 | A | 2/1982 | Lamb | |
| 4,336,097 | A * | 6/1982 | Van Kampen et al. | 156/527 |
| 4,486,263 | A * | 12/1984 | Monzo Gomez | 156/523 |
| 5,079,042 | A | 1/1992 | Frings | |
| 5,313,755 | A | 5/1994 | Koenig, Jr. | |
| 5,381,942 | A * | 1/1995 | Lin | 225/56 |
| 5,604,001 | A | 2/1997 | Schold | |
| 6,148,573 | A | 11/2000 | Smythe, Jr. | |
| 6,223,486 | B1 * | 5/2001 | Dunham | 52/254 |
| 2003/0024188 | A1 | 2/2003 | Smythe | |
| 2003/0033770 | A1 | 2/2003 | Harel | |
| 2004/0093816 | A1 | 5/2004 | Smythe | |
| 2005/0028483 | A1 | 2/2005 | Smythe | |
| 2006/0101746 | A1 | 5/2006 | Smythe | |

OTHER PUBLICATIONS

3M Company website (www.3m.com) one page.

* cited by examiner

*Primary Examiner*—Kahnh Nguyen
*Assistant Examiner*—Margaret Squalls
(74) *Attorney, Agent, or Firm*—John E. Simms, Jr.

(57) ABSTRACT

A joint compound guide bead dispenser, for finishing wallboard joints and a process for finishing wallboard joints. The guide bead dispenser includes a housing containing an adhesive coated cord wound on a rotatably mounted spool. The housing has an opening through which the cord passes and a roller rotatably mounted proximate to the opening. A cutting blade is mounted on the housing proximate to the opening. A length of cord may be payed out through the opening. The cord may be adhered to wallboard, proximate to a joint, by applying pressure with the roller and cut to selected length. Joint compound may be applied to cover the joint and smoothed to a uniform feathered finish by resting a straight edged knife on the wallboard and on the guide bead while moving the knife in a joint compound applying stroke.

4 Claims, 3 Drawing Sheets

PROCESS FOR FINISHING WALLBOARD JOINTS

CROSS REFERENCE TO RELATED APPLICATIONS

This application claims the benefit of Provisional Application No. 60/963,141, filed 2 Aug. 2007, by the present inventor.

BACKGROUND

In modern building projects, many interior walls are finished with wallboard. Wallboard is manufactured in solid sheets of standard size and may be referred to as drywall, sheet rock, or gypsum board depending on the mixture of materials used to form the solid sheets. Wallboard may be used in buildings having interior walls framed with metal or wooden studs. Wallboard sheets are typically attached to the studs, in adjacent side-by-side relation, to form a flat surface. Joints occurring between adjacent sheets are filled and smoothed to form a wall which appears seamless, at the joints. Joints occurring at wall corners are similarly filled. The walls are finished with a final coat of wall paper or paint.

Joints are typically filled by first applying a layer of paper or mesh tape and second by applying a first coat of joint compound, also referred to as spackle or mud. The joint tape is provided with adhesive, on one surface, for adhering the tape to the wallboard. The tape also retains a quantity of joint compound to prevent the entire joint from filling with joint compound. It is important that the joint compound penetrate the tape so that the joint compound and not the adhesive of the tape adheres to the wallboard, because the adhesive has relatively short effective life. The failure of the bond, in the area of the joint would release the joint tape together with any final coat of paint or wall paper, from the wall. It is also important that the tape retain joint compound to avoid waste and the tedious effort of packing the entire joint with joint compound.

After the tape is applied and coated with the first coat of joint compound, a second coat of joint compound is applied. A straight edged knife is commonly used to smooth and feather the second coat of joint compound to form a uniform surface making the joint undetectable under a final coat of paint or wall paper. A section of wall, which is larger than a single sheet of wallboard will have flat joints between adjacent coplaner sheets of wallboard. Typically wallboard sheets are manufactured with tapered edges so as to form a valley at each joint, which may be filled with a quantity of joint compound allowing the volume of joint compound to form a more substantial bond. Inside corners normally have a vertical joint where sheets of wallboard lie adjacent at a ninety degree angle. Inside corners are typically taped and coated with joint compound in the same manner as flat joints. Outside corners also have a vertical joint between sheets of wallboard lying at a ninety degree angle and with an edge of one or more sheets of wallboard exposed. The exposed edge is frequently covered with a metal angle strip running from the floor to the ceiling. The angle strip is attached to the wallboard with nails. The spine of the angle strip is provided with a raised rounded bead to facilitate the application of joint compound.

Joint compound is typically applied with a straight edged knife, commonly referred to as a tape knife, by scooping a quantity of joint compound onto the knife and delivering the joint compound to the area of wall to be coated. A user manipulates the knife by moving the knife along the joint with a leading edge slightly displaced from the wall and a trailing edge contacting the wall to spread joint compound along the joint and force joint compound into recesses in the surface of the wall. Recesses may include the joint between adjacent sheets of wallboard and depressions formed by nails used to attach the wallboard. As the knife is moved, the user must maintain some degree of displacement between the leading edge of the knife and the wall but the degree of displacement is not critical. The trailing edge of the knife must contact the wall where the feathered limit of the joint compound application is intended to blend with the surface of the wallboard and the trailing edge must be slightly displaced from the wall, in the area of the joint, where a thicker application of joint compound is desired. If the user varies the angle of the trailing edge, as the knife is moved, an undesirable undulating application of joint compound will result instead of the desired uniform feathered blend with the surface of the wallboard.

An outside corner, provided with an angle strip having a bead on the spine, is easily finished with the second coat of joint compound. The difficulty of maintaining a constant angle of the trailing edge of the knife is avoided because the bead provides a guide. The user rests the trailing edge of the knife against the bead and against the wallboard at the point intended to be the limit of feathering, for the joint compound. The bead displaces the trailing edge from the wall, in the area of the joint, and the user may apply steady pressure to maintain a consistent angle of the trailing edge throughout the movement of a full stroke of the knife. The knife will deposit a thicker application of joint compound in the area of the joint, and gradually taper the thickness to achieve a feathered blend with the wallboard. Each side of the outside corner joint may be finished in the same manner.

Inside corners and flat wall joints do not have a guide bead to position the trailing edge of the knife, for the user. Typically, professionals have developed their skill to a level so that they can maintain a constant angle of the trailing edge of the knife throughout a stroke and deposit a thicker application of joint compound in the area of a joint and uniformly taper the application to blend smoothly with the wallboard. A homeowner typically finds the task of applying the second coat of joint compound to inside corners and flat wall joints to be a tedious and time consuming job. There is a need for a guide bead which can be applied to wallboard for finishing inside corners and flat wall joints, to avoid the need for manually controlling the angle of the trailing edge of a tape knife. This need has been addressed by integrating a bead with tape, see U.S. Pat. No. 4,313,991, to Lamb. The Lamb Patent '991 discloses the use of two different tapes, one for corners and one for flat joints. This requires the user to maintain two products to complete a typical project involving both corners and flat joints. In addition, the tape includes substantial areas which are impervious to joint compound so the bond with the wallboard must be dependent upon the adhesive provided on the tape.

There is a need for a guide bead dispenser for convenient application of a single type of guide bead useful for inside corners and flat joints. There is a need for a process for finishing wallboard joints which provides a positioning guide bead for a knife applying joint compound to inside corners and to flat joints.

SUMMARY OF THE INVENTION

It is an object of the present invention to provide a guide bead dispenser for finishing wallboard, which conveniently adheres a length of adhesive coated cord adjacent to a flat wallboard joint for forming a guide bead.

It is a further object of the present invention to provide a guide bead dispenser for finishing wallboard, which conveniently adheres a length of adhesive coated cord proximate to an inside corner wallboard joint for forming a guide bead.

It is yet another object of the present invention to provide a process for finishing wallboard joints which provides a guide bead for properly positioning a straight edged knife during a stroke.

It is another object of the present invention to provide a process for finishing wallboard joints which provides a guide bead adhered to wallboard and allows joint compound to adhere directly to wallboard surface.

The present invention is a guide bead dispenser for finishing wallboard joints and a process for finishing wallboard joints. The guide bead dispenser includes a housing designed for convenient manual manipulation. The housing has an opening communicating with an inside space. A spool is rotatably mounted within the inside space and a cord, having a first end and a second end is provided. The first end of the cord is fixed to the spool and an intermediate portion of the cord is wound onto the spool such that the second end of the cord extends outward through the opening. The cord is coated with adhesive. A roller is mounted to the housing proximate to the opening. A cutting blade is mounted to the housing also proximate to the opening. The cord may be payed out through the opening and adjacent to the roller. The housing may be manipulated to adhere the second end of the cord to a sheet of wallboard proximate to a joint to be finished and to press the roller against the cord. A user may hold the second end of the cord in place and draw the housing along the path intended for application of the cord, while applying pressure with the roller. The intermediate portion of the cord will pay out as the roller presses the cord onto the wallboard causing the adhesive coating to adhere the cord to the wallboard. For finishing a flat joint, it is preferred that the cord be adhered to the tape directly overlaying the joint. For finishing an inside corner, it is preferred that the cord be adhered parallel and approximately three to four centimeters from the joint. Once the cord is adhered along the full length of the joint, the housing may be manipulated to bring the cutting blade to bear on the cord, for cutting the cord.

With the cord in place, a second coat of joint compound may be applied using the cord as a guide bead for maintaining a constant angle of the trailing edge of the knife. The trailing edge of a tape knife may be rested on the guide bead and the wallboard. The knife may be moved along the guide bead to deposit a thicker application of joint compound proximate to the joint and to taper the application of joint compound from the guide bead to blend smoothly with the wallboard.

The present invention also includes a process for finishing wallboard joints. For finishing a flat wallboard joint, the process includes the steps of first applying tape over the joint and second applying a thin layer of joint compound on the tape. Third, an adhesive coated cord may be adhered to the tape overlaying the joint, for forming a guide bead. Fourth a second coat of joint compound may be applied using a straight edged knife, by resting the trailing edge of the knife on the guide bead and on the wallboard during the stroke of the knife. A thicker application of joint compound will be deposited proximate to the joint and the joint compound application will taper gradually being feathered smoothly with the wallboard surface. In order to finish an inside corner joint, the process includes the steps of first applying tape over the joint and second applying a thin layer of joint compound on the tape. Third, an adhesive coated cord may be adhered to the tape parallel and approximately three to four centimeters from the joint, for forming a guide bead. Fourth, a second coat of joint compound may be applied using a straight edged knife, by resting the trailing edge of the knife on the guide bead and on the wallboard during the stroke of the knife. A thicker application of joint compound will be deposited adjacent to the joint and the joint compound application will taper gradually being feathered smoothly with the wallboard surface.

BRIEF DESCRIPTION OF THE DRAWINGS

The present invention may be further appreciated and understood with reference to the accompanying drawings in which.

DETAILED DESCRIPTION OF THE PREFERRED EMBODIMENT

Figure 1:
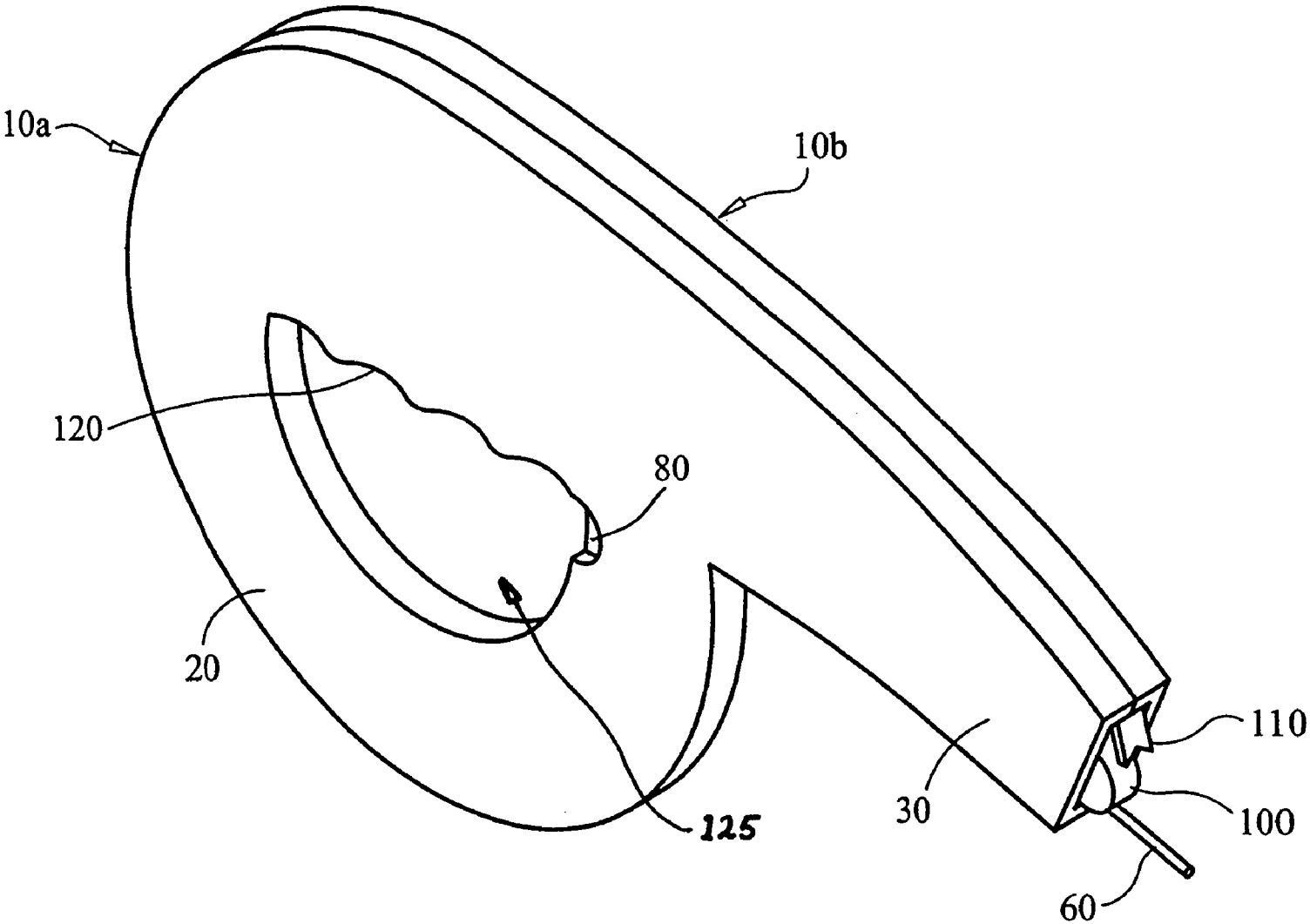
FIG. 1 is a side perspective view of the joint compound guide bead dispenser of the present invention.
Figure 2:
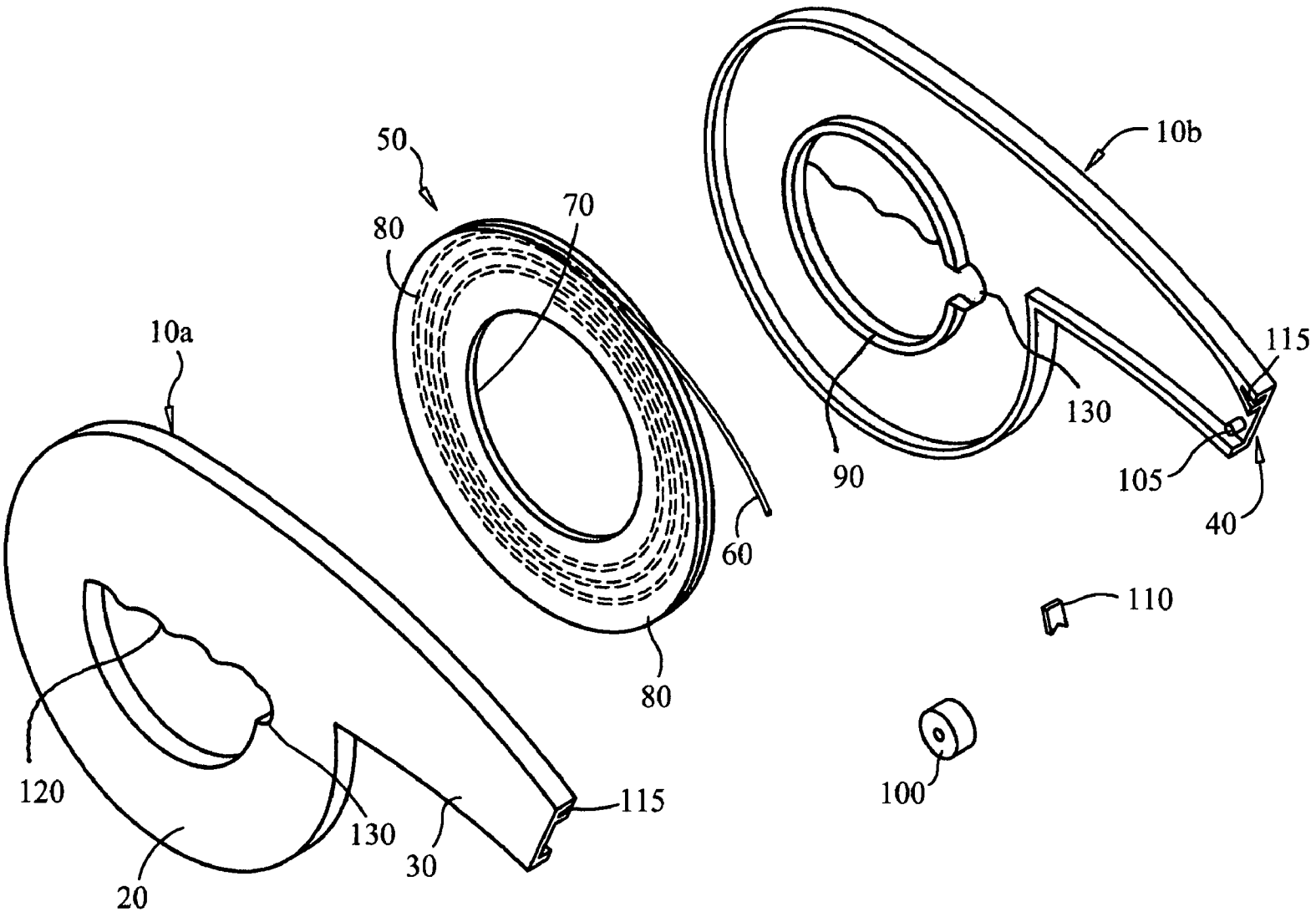
FIG. 2 is an exploded view of the joint compound guide bead dispenser of the present invention.

The present invention is a guide bead dispenser for finishing wallboard joints and a process for finishing wallboard joints. The guide bead dispenser, as shown in FIG. 1, comprises a housing preferably formed of half sections 10*a* and 10*b* defining an inside space and preferably consisting of a central body 20 and an integral chute 30. The chute 30 extends outward from the body 20, to a distal end at which an opening 40 is provided, as shown in FIG. 2. The opening 40 communicates with the inside space of the housing. The housing is preferably formed of lightweight rigid material such as metal or plastic.

As shown in FIG. 2, the housing consists of two half sections 10*a* and 10*b*, which are depicted in exploded view to illustrate the inside space. A spool 50 is rotatably mounted on the central body 20, within the inside space, as shown in FIG. 2. A cord 60, having a first end and a second end, is disposed on the spool 50. It is preferred that the first end of the cord 60 be attached to the spool 50, and that an intermediate portion of the cord 60 be wound onto the spool 50. The second end of the cord 60 extends outward through the chute 30 and passes through the opening 40 so as to be accessible outside the housing. The cord 60 is preferably approximately 0.1 to 0.4 centimeters (1/16 to 1/8 inches) in diameter and formed of natural or synthetic fiber. The cord 60 is preferably coated with pressure sensitive adhesive of the type applied to self adhesive mesh joint tape of conventional manufacture. The adhesive is kept fresh in the inside space of the housing. The spool 50 is preferably formed with a hub 70 for receiving the wound cord 60 and a pair of radial flanges 80 extending from opposite ends of the hub 70, for retaining the wound cord 60. Each of the half sections 10*a* and 10*b* is provided with one of a pair of rings 90 (one of which is shown) for rotatable mounting of the spool 50. A roller 100 is rotatably mounted on mounting means such as a pair of opposed pins 105 (one of which is shown) proximate to the distal end of the chute 30 proximate to the opening 40, with a portion of the roller 100 protruding through the opening 40. It is preferred that the cord 60 pass adjacent to the roller 100, as shown in FIG. 1. It is preferred that a cutting blade 110 be mounted on the distal end of the chute 30 opposite the location of the cord 60, as shown in FIG. 1. The cutting blade 110 may be mounted in a pair of slots 115 (one of which is shown). It is preferred that an integral grip 120 be provided on the housing, to facilitate gripping. As shown in FIG. 1, the hand grip 120 is formed in a passage 125 provided through the body 20 within the area bounded by the rings 90. It is also preferred that a notch 130 be provided in the housing to expose a portion of the flanges 80, such that a user may insert a finger into the notch 130 to contact a one of the flanges 80, for braking the rotation of the spool 50, as shown in FIGS. 1 and 2.

Figure 3:
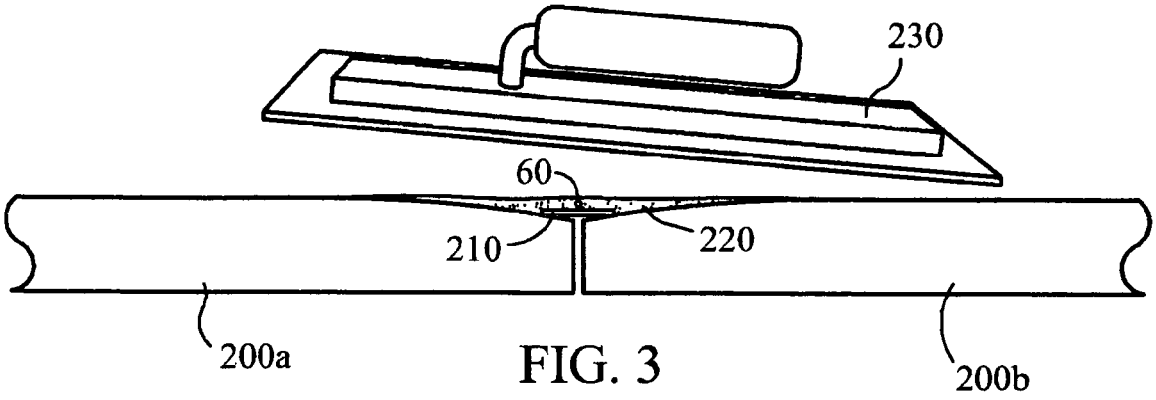
FIG. 3 is a cross-sectional view of a flat wallboard joint with guide bead in place and a straight edged knife in position according to the process of the present invention.

The guide bead dispenser, of the present invention, may be used to provide a guide bead to facilitate the application of a second coat of joint compound for achieving a uniform and smooth surface suitable for receiving a finish coat of paint or wall paper. The guide bead dispenser is particularly adapted for flat joints and inside corners. A flat joint typically exists between first and second adjacent coplaner sheets of wallboard 200*a* and 200*b*, respectively, as shown in FIG. 3. The edges of the sheets are frequently tapered so that the portions of each sheet adjacent to the joint cooperate to form a valley with the joint centrally located, as illustrated in FIG. 3, a cross-sectional view. In order to achieve a smooth and uniform finish, the second coat of joint compound 220 must fill the valley, to hide the joint, and gradually taper away from the joint, on each side, to a feathered limit of application at a boundary uniformly displaced from the joint. A user applies a strip of conventional joint tape 210 over the entire length of the joint, as shown in FIG. 3. The user applies a first coat of joint compound to penetrate the tape 210 and seal the area of the joint. The guide bead, of the present invention, is applied on the joint tape 210 approximately overlaying the joint. The user applies the guide bead by paying out a short length of cord 60, from the dispenser and holding the second end of the cord 60 in place on the joint 210 tape at an extreme end of the joint. The user pulls the dispenser along the joint applying pressure with the roller 100 to adhere the cord 60 to the joint tape 210 as the cord 60 pays out overlaying the joint. It is intended that the guide bead be coextensive with the joint. The cutting blade 110 is used to cut a selected length of cord 60 and release the dispenser. The user may insert a finger into the notch 130 to brake the spool 50 and facilitate cutting of the cord 60. With the guide bead in place, the user applies the second coat of joint compound 220. A quantity of joint compound is deposited onto the wallboard filling the valley and covering the guide bead. The user smooths the quantity of joint compound with a straight edged knife 230. The user manipulates the knife 230 so that during a stroke along the valley, a leading edge of the knife 230 is displaced from the surface of the wallboard to collect the joint compound on the underside of the knife 230. The trailing edge of the knife 230 is rested in contact with the wallboard and the guide bead, to force the joint compound to fill all voids as the knife 230 moves over the surface. The user rests the trailing edge of the knife 230 on the guide bead and on the first of the adjacent sheets of wallboard 200*a* during a first stroke. A second stroke is made with the trailing edge of the knife 230 resting on the guide bead and on the second of the adjacent sheets of wallboard 200*b*. The position of the knife 230 is illustrated in FIG. 3, which illustrates that the guide bead automatically maintains a constant angle of the trailing edge of the knife 230 throughout each stroke. The resting point of the trailing edge of the knife 230 on the wallboard is maintained at a constant displacement from the joint to achieve a uniform limit of application of the second coat of joint compound 220, for a smooth feathered boundary. After the second coat of joint compound 220 sets, the final finish coat of wall paper or paint may be applied without waves or other incongruities in the surface, in the area of the joints.

Figure 4:
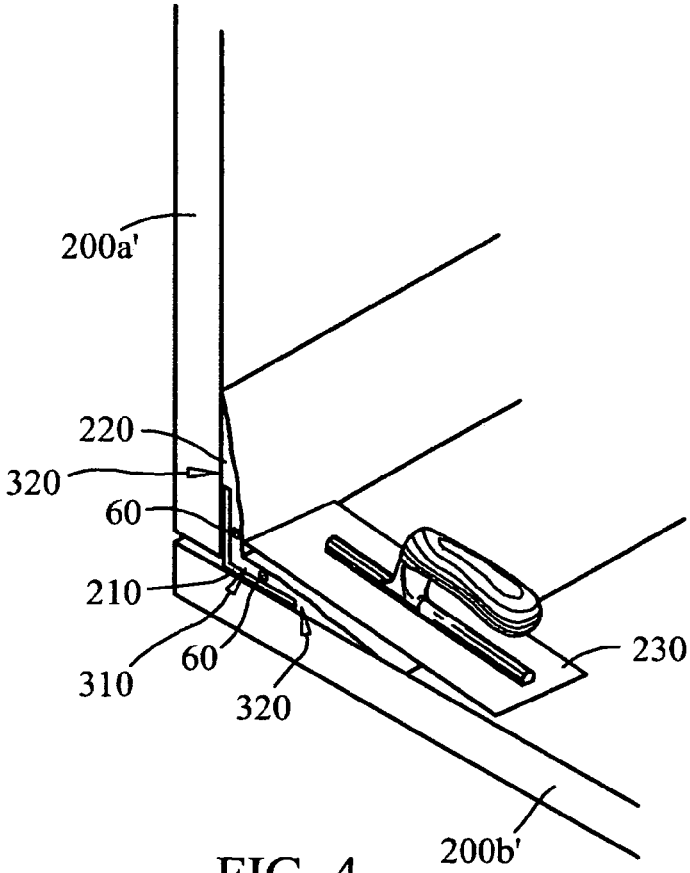
FIG. 4 is a cross-sectional view of an inside corner wallboard joint with a guide bead in place and a straight edged knife in position according to the process of the present invention.

An inside wall joint typically exists between first and second adjacent sheets of wallboard forming a ninety degree angle at the corner of a room 200*a*' and 200*b*', respectively, as shown in FIG. 4. In order to finish the inside corner joint, a user covers the joint with a strip of joint tape 210 running the length of the joint. The user applies a first coat of joint compound to penetrate the tape 210 and seal the area of the joint. In order to achieve a smooth and uniform finish, the second coat of joint compound 220 must fill the area of the joint, to hide the joint, and gradually taper away from the joint to a feathered limit of application at a boundary uniformly displaced from the joint, on each side. The user places a guide bead on each of the first and second adjacent sheets of wallboard 200*a*' and 200*b*', generally parallel to the joint and approximately three to four centimeters from the joint, defining a fill space 310 between each guide bead and the joint and a feathering space 320 on the opposite side of each guide bead. The user applies each guide bead by paying out a short length of cord 60, from the dispenser and holding the second end of the cord 60 in place, three to four centimeters from the joint, proximate to an extreme end of the joint. The user pulls the dispenser along the joint applying pressure with the roller 100 to adhere the cord 60 to the wallboard as the cord 60 pays out, for forming a guide bead. It is intended that the guide bead be coextensive with the joint. The cutting blade 110 is used to cut a selected length of cord 60 and release the dispenser. With the guide beads in place, the user applies the second coat of joint compound 220. A quantity of joint compound is deposited onto the wallboard, in the area of the fill space 310 and the feathering space 320, covering the guide bead. The user smooths the quantity of joint compound with a straight edged knife 230. The user manipulates the knife 230 so that during a stroke, a leading edge is displaced from the surface of the wallboard to collect the joint compound on the underside. The trailing edge is rested in contact with the wallboard and the guide bead to force the joint compound to fill all voids as the knife 230 moves over the surface. The user rests the trailing edge on one guide bead and on the first of the adjacent sheets of wallboard 200*a*' during a first stroke. A second stroke is made with the trailing edge of the knife 230 resting on the other guide bead and on the second of the adjacent sheets of wallboard 200*b*'. The position of the knife 230 is shown in FIG. 4, which illustrates that the guide bead automatically maintains a constant angle of the trailing edge of the knife 230 throughout each stroke. The resting point of the trailing edge on the wallboard is maintained at a constant displacement from the joint to achieve a uniform limit of application of joint compound, for a smooth feathered boundary. After the second coat of joint compound 220 sets, the final finish of wall paper or paint may be applied without waves or other incongruities in the surface, in the areas of the inside corner.

For finishing flat joints and inside corners, the guide bead of the present invention keeps the joint compound smooth and even at every joint. The application of joint compound may be accomplished quickly and easily by users having limited experience. The guide bead not only saves time but also saves joint compound since the application is thin, uniform, and even. Finally, the smooth and even application of joint compound requires significantly less sanding to finish the job.

Having fully described the present invention, it may be understood and appreciated that minor variations may be introduced without departing from the scope of the invention as disclosed and claimed herein.

I claim:

1. A process for finishing flat wallboard joints comprising the steps of:

applying joint tape to flat wallboard joints:

providing adhesive coated cord;

adhering said cord to said wallboard proximate to and overlaying said joints, to form a guide bead;

applying joint compound with a straight edged knife by resting the knife edge on the guide bead and on the wallboard during a joint compound applying stroke.

2. The process of claim 1, wherein said step of providing adhesive coated cord is accomplished by providing a joint compound guide bead dispenser comprising:

a housing having an opening communicating with an inside space, a spool, a roller assembly, and an adhesive coated cord;

said adhesive coated cord having a first end and a second end;

said spool being rotatably mounted in said inside space of said housing;

said first end, of said cord, being fixed on said spool, an intermediate portion of said cord being wound around said spool and said second end, of said cord, extending outward through said opening;

said roller assembly being mounted to said housing proximate to said opening;

said roller assembly including a roller and mounting means;

said mounting means being configured for supporting said roller adjacent to said cord and at least partially protruding through said opening, for facilitating the adhering of said cord to said wallboard with pressure from said roller, and said step of adhering said cord to said wallboard is accomplished by pressing said second end of said cord onto said wallboard, drawing said joint compound guide bead dispenser along an intended path for said guide bead, while pressing said intermediate portion of said cord onto said wallboard with pressure applied on said roller.

3. A process for finishing inside wallboard joints extending between first and second adjacent sheets of wallboard comprising the steps of:

applying joint tape to inside corner wallboard joints;

providing adhesive coated cord;

adhering said cord to each of said first and second sheets of wallboard proximate to said joints and spaced apart therefrom, to form first and second guide beads;

applying joint compound with a straight edged knife by resting the knife edge on the second guide bead and on the second sheet of wallboard during a joint compound applying stroke;

applying joint compound with a straight edged knife by resting the knife edge on the first guide bead and on the first sheet of wallboard during a joint compound applying stroke.

4. The process of claim 3, wherein said step of providing adhesive coated cord is accomplished by providing a joint compound guide bead dispenser comprising:

a housing having an opening communicating with an inside space, a spool, a roller assembly, and an adhesive coated cord;

said adhesive coated cord having a first end and a second end;

said spool being rotatably mounted in said inside space of said housing;

said first end, of said cord, being fixed on said spool, an intermediate portion of said cord being wound around said spool and said second end, of said cord, extending outward through said opening;

said roller assembly being mounted to said housing proximate to said opening;

said roller assembly including a roller and mounting means;

said mounting means being configured for supporting said roller adjacent to said cord and at least partially protruding through said opening, for facilitating the adhering of said cord to said wallboard with pressure from said roller, and said step of adhering said cord to said wallboard is accomplished by pressing said second end of said cord onto said wallboard, drawing said joint compound guide bead dispenser along an intended path for said guide bead, while pressing said intermediate portion of said cord onto said wallboard with pressure applied on said roller.

* * * * *